United States Patent [19]

Nitschko

[11] 4,405,152

[45] Sep. 20, 1983

[54] SKI BINDING JAW

[75] Inventor: Theodor Nitschko, Vienna, Austria

[73] Assignee: TMC Corporation, Baar, Switzerland

[21] Appl. No.: 285,702

[22] Filed: Jul. 22, 1981

[30] Foreign Application Priority Data

Aug. 26, 1980 [AT] Austria ..... 4300/80

[51] Int. Cl.[3] ..... A63C 9/22

[52] U.S. Cl. ..... 280/625; 280/630; 280/634

[58] Field of Search ..... 280/625, 634, 629, 630, 280/631, 632, 628, 626

[56] References Cited

U.S. PATENT DOCUMENTS 4,166,639 9/1979 Svoboda et al. ..... 280/625

FOREIGN PATENT DOCUMENTS 315035 5/1974 Austria ..... 280/628

*Primary Examiner*—David M. Mitchell
*Assistant Examiner*—Pierre Huggins
*Attorney, Agent, or Firm*—Flynn, Thiel, Boutell & Tanis

[57] ABSTRACT

A ski binding front jaw has a cylindrical sleeve supported on a ski-fixed housing for axial movement parallel to the longitudinal axis of the ski in response to movement of ski boot engaging sole holders. An adjusting screw has an end portion rotatably and axially slidably supported in the sleeve, a threaded portion spaced from the end portion which threadedly engages an abutment, and a central portion of lesser diameter than the end portion adjacent thereto. A hollow cylinder is rotatably and axially slidably supported on the sleeve coaxial therewith by a first inner surface and has a second inner surface of greater diameter than the first surface adjacent thereto. The sleeve has a plurality of circumferentially spaced radial openings, and a spherical ball is disposed in each opening. The radial distances between the screw central portion and cylinder first surface and the screw end portion and cylinder second surface substantially equal the diameter of the balls. Helical release, return and reset springs coaxially encircle the adjusting screw and respectively extend between the abutment and housing, sleeve and housing, and abutment and cylinder.

12 Claims, 4 Drawing Figures

SKI BINDING JAW

FIELD OF THE INVENTION

This invention relates to a front jaw for a safety ski binding and, more particularly, to such a jaw having a pair of two-arm sole holders supported for pivotal movement about respective vertical bolts and having one arm engaging the ski shoe sole and the other arm engaging a slide member which is movable against the adjustable force of a spring, which spring becomes relaxed after a swinging out of one of the two sole holders which exceeds a limit defined by means of a release edge, wherein for returning the slide member at least one return spring is provided.

BACKGROUND OF THE INVENTION

A jaw of the above-mentioned type is, for example, described in Austrian Pat. No. 343 027. In this conventional construction, the slide member has a cam, a downwardly projecting end of which extends into a recess of the slide member and the other end of which is loaded by arms of the sole holders. During a lateral swinging out of one of the two sole holders, its arm which engages the cam pulls along the cam and thus the slide member. The end of the cam which extends into the recess of the slide member moves, upon reaching a predetermined position, along a guideway which has a release edge. Upon exceeding the release edge, the slide member is released and returns to its initial position under the action of the spring, and the sole holder can now swing outwardly without further overcoming the force of the release spring. In this conventional construction, however, due to the unfavorable points of engagement of the cam, which points lie barely above the base plate, relatively high forces between the cam and the guideway must be overcome. Further, high sliding friction occurs between these structural parts which places high demands on the materials and renders the jaw susceptible to trouble.

From German OS No. 15 78 973 a jaw is known which is supported pivotally outwardly about a pivot pin arranged on a ski-fixed base plate. In a guideway which is constructed concentrically with respect to the pivot pin, there is disposed a locking mechanism. The locking mechanism consists substantially of a slide member which is loaded on both sides by respective springs and receives a small lower locking ball, and a larger upper locking ball which, in the downhill skiing position of the jaw, rests on the lower ball and is loaded by a further spring. Both balls are held in locking recesses in the downhill skiing position of the jaw. When a force acts laterally on the jaw, the slide member is moved in the guideway against the force of one spring which loads it, the lower ball is released from its locking recess and simultaneously lifts the upper ball. After a certain angle of swing of the jaw, the upper ball disengages from its locking recess, which causes the slide member together with the lower ball to return into its initial position. The upper ball swings outwardly together with the jaw until the release of the ski shoe is effected. This release system, however, is created for a one-part sole holder and cannot be transferred to a system with a pair of two-arm sole holders. Also, in the case of this jaw, due to the special spring arrangement, the desired approximately continuously increasing release force does not exist. Also, after a release operation, the jaw must be returned manually to its initial position.

Therefore, the basic purpose of the invention is to design a jaw of the above-mentioned type so that it does not have the mentioned disadvantages of the conventional constructions and so that, after an exceeding of the elasticity limit, the release force is instantaneously and significantly reduced.

SUMMARY OF THE INVENTION

The set purpose is attained inventively by providing a jaw of the above-mentioned type in which the adjusting screw consists preferably of three sections which are offset from one another, the center section having a smaller diameter than the two outer sections, and the section remote from the adjustable abutment having a locking edge which offsets it from the center section and being supported rotatably and movably in a sleeve which is fastened on the slide member, which sleeve supports balls which rest both on a cylinder which at least partially surrounds the sleeve and also on the adjusting screw, on which cylinder is constructed the release edge, wherein the balls in the downhill skiing position of the jaw engage the locking edge of the adjusting screw.

The inventive measures achieve the set goal satisfactorily. Due to the fact that the locking edge is constructed on the adjusting screw and the release edge on the cylinder which concentrically surrounds the adjusting screw, and the fact that both are arranged concentrically with respect to the release spring, moments which could influence the desired release force do not occur. The elasticity range of the jaw is determined by the distance of the locking edge from the release edge in the downhill skiing position, and can be chosen from within a relatively large range. By using balls, a sliding friction occurs only between the structural parts which determine the elasticity range.

An important characteristic of the invention consists in the sleeve being open on one side and having in the area of its open end on its outer periphery a thickened portion which extends concentrically with respect to the remaining area, which thickened portion has openings for receiving the balls circumferentially evenly distributed so as to define a circular ring. The support of the balls in the sleeve occurs thus in a manner which, in the downhill skiing position of the jaw, assures a secure support of the balls on the locking edge of the adjusting screw.

A further thought of the invention consists in the sleeve being surrounded by the return spring, which is a pressure spring and has one end supported on the thickened sleeve portion and its other end supported on an abutment which is connected to the support member, on which abutment is also supported the release spring. The return spring is thus stored space-savingly, its support on the abutment which is fixedly connected to the support member and which advantageously is also the abutment for the release spring assuring, during a swinging out of the sole holder, an initial tensioning of the return spring.

The cylinder is designed according to a further characteristic of the invention as a hollow member which is open at both ends, on the inner surface of which the release edge is designed as a sloped surface which forms a transition to a cylinder area having a larger inside diameter than the remaining area. By swinging out the sole holder, the slide member together with the sleeve is pulled along. Due to the arrangement of the release edge, the balls become released from the locking edge of the adjusting screw, the spring relaxes and the sole holders can swing further outwardly almost force-free.

The return of the cylinder after a release operation to its downhill skiing position is assured inventively by the cylinder having a shoulder on its outer periphery, on which shoulder is supported one end of a reset spring arranged concentrically about the adjusting screw, the other end of the reset spring being supported on the adjustable abutment, the reset spring being a compression spring which urges the cylinder toward the support member.

A further, important characteristic of the invention consists in the force of the reset spring being less than the force of the return spring and the force of the return and reset springs being substantially less than the force of the release spring. The return spring applies thereby only a small resistance on the sole holder so that, after an exceeding of the release edge, one can speak of a further release movement without any substantial resistance. Since the force of the reset spring is less than the force of the return spring, after a release operation the slide member is first returned into its initial position, carrying with it the sleeve. Then, as soon as the balls are again supported on the locking edge, the reset spring assures the return of the cylinder.

BRIEF DESCRIPTION OF THE DRAWINGS

Further characteristics, advantages and details of the invention will now be described in greater detail in connection with the drawings, which illustrate one exemplary embodiment.

In the drawings.

DETAILED DESCRIPTION

Figure 1:
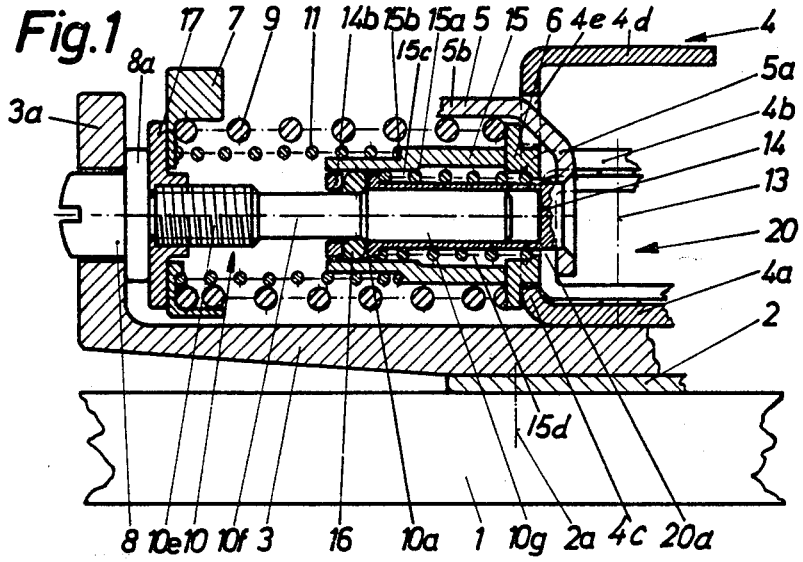
FIG. 1 is a sectional side view of an inventive jaw in the downhill skiing position.

A base plate 2 which carries a housing 3 of the jaw is secured by means of schematically illustrated screws 2*a* on a ski 1. Alternatively, the base plate 2 can be supported in a conventional manner on a not illustrated ski-fixed guide rail for movement in the longitudinal direction of the ski and can be secured in various positions along the rail. The portion of the housing 3 which extends approximately parallel to the upper side of the ski carries a support member 4 which is preferably connected fixedly to the housing 3. The support member 4 has a support plate 4*a* which rests on the housing 3 and which transfers at its end closest to the tip of the ski into a portion 4*c* which extends upwardly at a right angle to the upper side of the ski, which carries at each lateral side a fastening piece 4*b* which extends parallel to the support plate 4*a*, and which trnasfers at its upper end into a horizontal portion 4*d* which is bent approximately at a right angle to the portion 4*c* and is adapted to support a sole hold-down which is not illustrated. The sole hold-down threadedly engages and is supported pivotally on a not illustrated vertical bolt which extends between the support plate portions 4*a* and 4*d* and the sole hold-down can be adjusted vertically by rotating the bolt to adapt it to different thickness ski shoe soles. The bolt and sole hold-down are conventional and do not form a part of the subject matter of the present invention.

Two spaced, schematically illustrated bolts 13 positioned normal to the upper side of the ski are arranged on the support plate 4*a* and/or the two fastening pieces 4*b* of the support member so as to be symmetric with respect to the longitudinal axis of the ski, on each which bolt is pivotally supported a sole holder 20, which is advantageously designed as a two-arm lever. The sole holders 20 each have one arm which is adapted to engage a not illustrated ski shoe sole and a second arm 20*a* which points inwardly in the direction of the longitudinal axis of the ski. This arrangement of the sole holders is also conventional. The arms 20*a* which point in the direction of the longitudinal axis of the ski each engage a downwardly bent section 5*a* of a slide member 5, the remaining portion 5*b* of which extends approximately parallel to the upper side of the ski.

An opening 4*e* is provided through the portion 4*c* of the support member 4, and the horizontal portion of the slide member 5 extends slidably therethrough.

A release spring 9 is supported with one end on an abutment 6 which is arranged on the upwardly projecting portion 4*c* of the support member 4 and connected fixedly to same. The other end of the spring 9 is supported in a further, sleeve-shaped abutment 7 which has a nut 17 associated with it, which nut 17 threadedly engages a threaded portion 10*e* of an adjusting screw 10, which screw 10 is arranged coaxially within the spring 9 and is described in greater detail below. One end of the adjusting screw 10 is provided with a screwhead 8 which, in the position of the jaw according to FIG. 1, extends through a circular opening in the housing portion 3*a* and has a collar 8*a* which in the position of FIG. 1 is supported against the housing portion 3*a*. The initial tension of the spring 9 can be adjusted by rotating the screwhead 8 to move the nut 17 and abutment 7 axially along the screw 10, the resulting spring initial tension being visually readable on a not illustrated and conventional indicating device.

The adjusting screw 10 has three sections 10*e*, 10*f* and 10*g*, which are radially offset from one another so that the center section 10*f* has a smaller diameter than the two outer sections 10*e* and 10*g*, of which the section 10*e* is provided with the screw-thread, carries the nut 17 for abutment 7, and has a slightly larger diameter than the section 10*g*.

The end section 10*g* which is remote from the abutment 7 is supported rotatably and longitudinally movably in a cylindrical ball support sleeve 14 having one closed end, the end of the screw section 10*g* being spaced from the closed end of the sleeve 14.

The sleeve 14 extends through a central opening in the spring abutment 6 and the opening 4*e* in the support member 4, the closed end of the sleeve 14 being secured to the bent section 5*a* of the slide member 5. The sleeve 14 has around its outer periphery in the area of its open end a thickened portion 14*b*, in which thickened portion are provided plural, circumferentially spaced openings for receiving spherical balls 16. The openings are distributed evenly so as to form a circular ring about the periphery of the thickened portion 14*b*. Openings for at least three balls 16 are provided. The diameter of each opening is selected so that each ball 16 sits in the associated opening with a small amount of play, the thickness of the thickened portion 14*b* being slightly less than the diameter of the balls 16.

The balls 16, in the downhill skiing position of the jaw, engage a sloped annular surface or locking edge 10*a* provided on the periphery of the adjusting screw 10 between the section 10*f* and the section 10*g*.

The sleeve 14 is coaxially surrounded by a return spring 12 which is a helical compression spring, has a small spring force, and has one end supported on the abutment 6 and its other end supported on the thickened portion 14*b* of the sleeve 14.

The just described structural parts are surrounded by a hollow cylinder 15 which is open on both ends and is concentric with respect to the adjusting screw 10. In the downhill skiing position of the jaw, the surfaces of the open end of the sleeve 14 and the associated open end of the cylinder 15 preferably lie substantially in a common plane. Starting from this end of the cylinder 15, the inside diameter of the cylinder 15 is dimensioned so that the balls 16 of the sleeve 14 engage the inner surface 15*c* of the cylinder 15 in the downhill skiing position of the jaw. Approximately in the axial center of the cylinder 15 there is constructed on its inner surface a sloped, annular surface or release edge 15*a* which effects a transition to an inside surface 15*d* of larger diameter than the surface 15*c*.

A reset spring 11, which is a compression spring, is arranged concentrically about the adjusting screw 10, has one end supported on the abutment 7 and its other end supported on a shoulder 15*b* provided on the outer periphery of the cylinder 15, and presses the cylinder 15 against the abutment 6 which is fixedly connected to the support member 4. The force of the reset spring 11 is chosen to be smaller than the force of the return spring 12.

Figure 2:
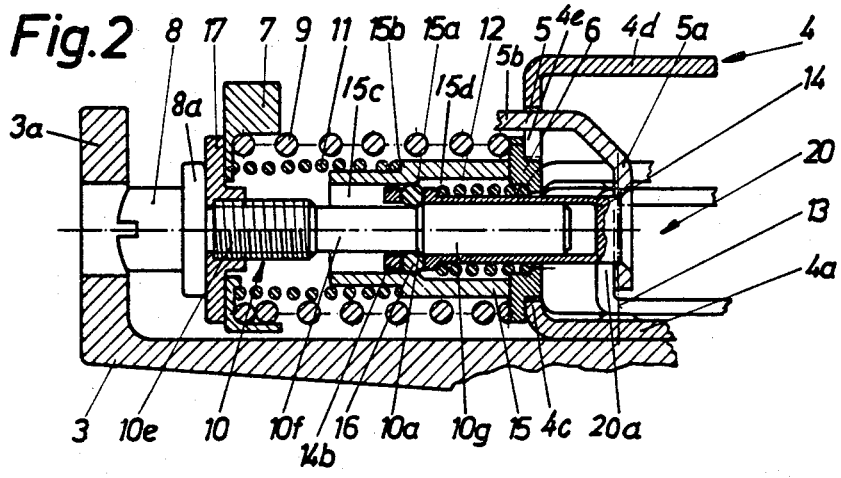
FIG. 2 is a sectional side view illustrating the position of the jaw of FIG. 1 just before the elasticity limit is exceeded.
Figure 3:
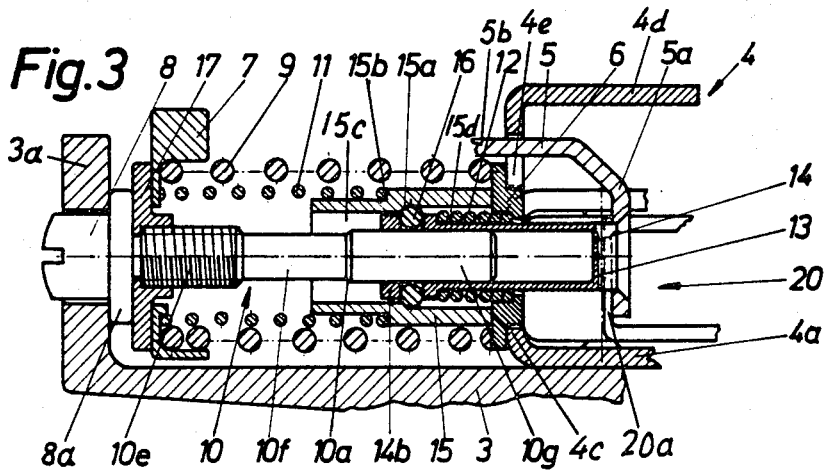
FIG. 3 is a sectional side view illustrating the position of the jaw of FIG. 1 after the elasticity limit has been exceeded.

If a horizontal force acts onto a not illustrated ski shoe which is inserted into the building, which force is larger than the adjusted force of the spring 9, then one of the sole holders 20 will be pivoted outwardly about its bolt 13 by the ski shoe. The arm of the sole holder 20 which engages the bent section 5*a* of the slide member 5 pulls the slide member 5 rearwardly together with the adjusting screw 10 and the sleeve 14. The springs 9 and 12 which are supported on the abutment 6 of the stationary support member 4 and the spring 11 which is supported on the support edge 15*b* of the stationarily remaining cylinder 15 are thus compressed. The balls 16 first remain on the locking edge 10*a* of the adjusting screw 10. When the point of the swing-out movement of the sole holder 20 or of the movement of the slide member 5 is reached at which the balls 16 reach the inclined surface 15*a* of the cylinder 15, which position is illustrated in FIG. 2, then the elasticity limit is reached, namely the limit up to which the sole holders 20 would swing back into their initial position if the relatively small force which acted onto them were terminated. Upon an exceeding of the elasticity limit, however, the balls 16 roll across the inclined surface 15*a* of the cylinder 15 and thus free the inclined surface 10*a* of the adjusting screw 10 so that the adjusting screw 10 returns to its initial position under the action of the spring 9, which position is illustrated in FIG. 3, as a result of which the spring 9 becomes relaxed. It can easily be recognized that, upon exceeding the elasticity limit defined by the inclined surface 15*a*, an interruption of the coupling between the sole holders 20 and the spring 9 takes place, so that each sole holder 20 can swing outwardly about its bolt 13 against only the small, nominal force of the spring 12, and the further release movement of the ski shoe occurs practically without resistance.

In other words, when a horizontal force acts on the not illustrated ski boot and causes a pivotal movement of one of the sole holders 20, the arm 20*a* of that sole holder 20 pulls the slide member 5 and the sleeve 14 attached thereto rearwardly. The surface 15*c* of the cylinder 15 prevents the balls 16 from moving radially outwardly, so the balls engage the inclined surface 10*a* of the screw 10 and pull the screw 10, the nut 17 and the abutment 7 rearwardly, compressing the spring 9, 11 and 12, as shown in FIG. 2. As the screw 10 and sleeve 14 move past the inclined surface 15*a* of the cylinder 15, the larger diameter of the surface 15*d* of the cylinder eventually becomes aligned with and permits the balls 16 to move sufficiently radially outwardly so that they no longer engage the surface 10*a* of the screw 10, and the screw 10 is then moved forwardly with respect to the sleeve 14 under the urging of the springs 9 and 11 until the collar 8*a* engages the housing portion 3*a*, as illustrated in FIG. 3. Then, only the spring 12 is still urging the sleeve 14 and slide member 5 forwardly, and only the relatively small force of the spring 12 must now be overcome to effect the further pivotal movement of the sole holders 20 and associated rearward movement of the slide member 5 necessary to effect a complete exit of the ski boot from the binding jaw.

Figure 4:
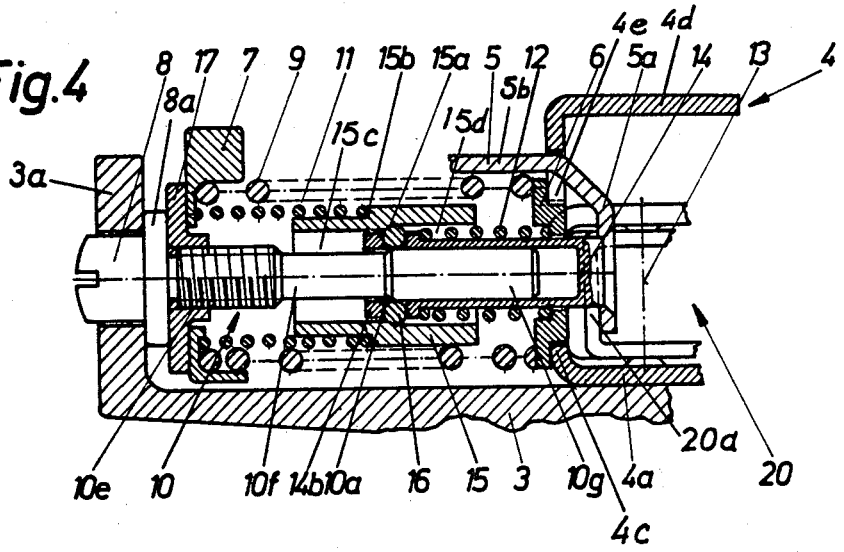
FIG. 4 is a sectional side view illustrating the jaw of FIG. 1 in a position as it returns to its downhill skiing position after a release operation.

When the ski shoe has come free from the sole holders 20, the slide member 5 and the sleeve 14 are moved under the action of the return spring 12 in a direction toward the tip of the ski to their initial positions, whereby the sole holders 20 are also returned to their initial positions. The balls 16 are prevented by the screw portion 10*g* from moving radially inwardly and thus engage the inclined surface 15*a* of the cylinder 15 and move the cylinder 15 axially forwardly against the smaller force of the reset spring 11, as shown in FIG. 4, whereby the balls 16 slide along the section 10*g* of the adjusting screw. Upon reaching the inclined surface 10*a* of the adjusting screw 10, the balls 16 move radially inwardly across the surface 10*a* to their initial position. Since the balls 16 no longer engage the inclined surface 15*a*, the reset spring 11 moves the cylinder 15 rearwardly to its original position against the abutment 6, and the jaw is again in the position of FIG. 1 and is ready for use.

Although a particular preferred embodiment of the invention has been disclosed in detail for illustrative purposes, it will be recognized that variations or modifications of the disclosed apparatus, including the rearrangement of parts, lie within the scope of the present invention.

The embodiment of the invention in which an exclusive property or privilege is claimed is defined as follows:

1. In a front jaw for a safety ski binding, having a pair of two-arm sole holders which are arranged symmetrically with respect to the longitudinal center plane of said jaw and are pivotally arranged on a pivot means arranged vertically with respect to the upper side of a ski, each said sole holder having a first arm adapted to engage a ski shoe sole and a second arm engaging a slide member which is movable against the force of a release spring, said release spring having one end thereof supported on a fixed abutment means and its other end supported on an adjustably movable abutment means, said adjustably movable abutment means including an adjusting screw which extends in the longitudinal direction of said ski, said release spring becoming relaxed after a swinging out of one of said two sole holders which exceeds a predetermined limit, and wherein for returning said slide member at least one return spring is provided, the improvement comprising wherein said adjusting screw comprises three sections which are axially offset from one another, the center section having a smaller diameter than the two outer sections and the outer section adjacent said fixed abutment means having a locking edge thereon which radially offsets it from said center section, said adjusting screw being rotatably and axially movably supported in a sleeve which is secured to said slide member, an outer cylinder at least in an axial direction, partially surrounding said sleeve, said sleeve having plural balls thereon which rest both on an interior wall of said outer cylinder and said adjusting screw, means defining a release edge on said interior wall of said outer cylinder initially located between said fixed abutment means and said locking edge when said jaw is in a ski boot holding position, and wherein said balls in said ski boot holding position of said jaw engage said locking edge of said adjusting screw.

2. The jaw according to claim 1, wherein said sleeve is open at one end and adjacent said open end a thickened portion is provided which extends concentrically with respect to the remaining portion, said thickened portion having at least three openings extending therethrough each receiving a ball therein, said openings being circumferentially equidistantly spaced so as to define a circular ring.

3. The jaw according to claim 2, wherein said sleeve is surrounded by said return spring, said return spring being a compression spring and having one end thereof supported on said thickened portion of said sleeve and its other end supported on said fixed abutment means on which is also supported said release spring.

4. The jaw according to claim 1, wherein said cylinder is a hollow member having a circular opening extending therethrough and which is open at both ends, said release edge being defined by a sloped surface which forms a transition between two interior cylindrical portions, one having a larger inside diameter than the other.

5. The jaw according to claim 1 or 2, wherein said cylinder includes a shoulder on its outer periphery, a reset spring is provided and is arranged concentrically about said adjusting screw, one end of said reset spring engaging said shoulder on said cylinder, the other end of said reset spring being supported on said adjustably movable abutment means, and wherein said reset spring is a compression spring and urges said cylinder toward said fixed abutment means.

6. The jaw according to claim 5, wherein the force of said reset spring is smaller than the force of said return spring, and wherein the force of said return and reset springs is substantially smaller than the force of said release spring.

7. In a front jaw for a safety ski binding, having a pair of two-arm sole holders which are arranged symmetrically with respect to the longitudinal center plane of said jaw and are pivotally arranged on a pivot means arranged vertically with respect to the upper side of a ski, each said sole holder having a first arm adapted to engage the sole of a ski shoe and a second arm engaging a slide member which is movable against the force of a release spring, said release spring having one end thereof supported on a fixed abutment means and its other end supported on an adjustably movable abutment means, said adjustably movable abutment means including an adjusting screw which extends in the longitudinal direction of said ski, said release spring, after a swinging out of at least one of said two sole holders becoming relaxed after a predetermined travel of said slide member, and wherein for returning said slide member at least one return spring is provided, the improvement comprising wherein said adjusting screw has three sections, namely, a threaded section at one end and two axially spaced and serially disposed sections, the section most remote from said threaded section having a larger diameter than the remaining section, wherein a locking edge is provided intermediate said most remote and remaining sections, a sleeve mounted on said slide member, an outer cylinder at least partially encircling said adjusting screw in an axial direction and having two axially spaced different diameter portions therein, plural balls mounted on said sleeve and engaging the smaller diameter inner surface portion of said outer cylinder, so that said sleeve is coupled by said locking edge to said adjusting screw by said balls, means defining a release edge on the interior of said outer cylinder separating two different diameter portions thereof, said release edge being located, in a ski boot holding position, intermediate said locking edge and said fixed abutment means, and wherein, after exceeding a first phase of a release, namely, after a predetermined travel of said slide member, said balls will reach a larger inside diameter portion of said outer cylinder, so that said balls will release the locking edge of said adjusting screw to enable said adjusting screw to move relative to said sleeve and thereby render said sole holders free of influence from said release spring.

8. The jaw according to claim 7, wherein said sleeve is open at one end and adjacent said open end a thickened portion is provided which extends concentrically with respect to the remaining portion, said thickened portion having at least three openings extending therethrough each receiving a ball therein, said openings being circumferentially equidistantly spaced so as to define a circular ring.

9. The jaw according to claim 8, wherein said sleeve is surrounded by said return spring, said return spring being a compression spring and having one end thereof supported on said thickened portion of said sleeve and its other end supported on said fixed abutment means on which is also supported said release spring.

10. The jaw according to claim 7, wherein said cylinder is a hollow member having a circular opening extending therethrough and which is open at both ends, said release edge being defined by a sloped surface which forms a transition between two interior cylindrical portions, one having a larger inside diameter than the other.

11. The jaw according to claim 7 or 8, wherein said cylinder includes a shoulder on its outer periphery, a reset spring is provided and is arranged concentrically about said adjusting screw, one end of said reset spring engaging said shoulder on said cylinder, the other end of said reset spring being supported on said adjustably movable abutment means, and wherein said reset spring is a compression spring and urges said cylinder toward said fixed abutment means.

12. The jaw according to claim 11, wherein the force of said reset spring is smaller than the force of said return spring, and wherein the force of said return and reset springs is substantially smaller than the force of said release spring.

* * * * *